United States Patent [19]

Fritz et al.

[11] Patent Number: 4,462,702

[45] Date of Patent: Jul. 31, 1984

[54] DOT MATRIX LINE PRINTER

[75] Inventors: William O. Fritz, Anaheim; John C. Chamberlain, Irvine; Gary C. Chandler, Laguna Beach, all of Calif.

[73] Assignee: Trilog, Inc., Irvine, Calif.

[21] Appl. No.: 386,199

[22] Filed: Jun. 7, 1982

[51] Int. Cl.[3] ..... B41J 3/12

[52] U.S. Cl. ..... 400/58; 101/93.04; 101/93.09; 400/121; 400/649; 400/656

[58] Field of Search ..... 400/58, 121, 692, 693, 400/701, 649, 653, 656; 101/93.04, 93.05, 93.09

[56] References Cited

U.S. PATENT DOCUMENTS

| | | | |
|---|---|---|---|
| 3,357,533 | 12/1967 | Artzt | 101/93.04 X |
| 3,941,051 | 3/1976 | Barrus et al. | 400/121 X |
| 3,951,251 | 4/1976 | Zaccagnino | 400/58 X |

FOREIGN PATENT DOCUMENTS

| | | | |
|---|---|---|---|
| 2844150 | 4/1979 | Fed. Rep. of Germany | 400/58 |
| 56-27358 | 3/1981 | Japan | 400/121 |

*Primary Examiner*—Paul T. Sewell

*Attorney, Agent, or Firm*—Freilich, Hornbaker, Rosen & Fernandez

[57] ABSTRACT

A dot matrix line printer comprised of a main frame assembly and a shuttle frame assembly hinged thereto for limited pivotal movement around a horizontal hinge axis. The main frame assembly carries a paper drive subassembly and an adjustable platen subassembly. The shuttle frame assembly carries one or more hammer banks and a shuttle drive motor for shuttling each bank to move the hammers thereof along a print row extending across the width of the paper parallel to the front face of the platen. By pivoting the shuttle frame assembly up and away from the main assembly, ready access is afforded to the paper path for loading and to the hammer banks for servicing. Each hammer includes a hammer element mounted on the free ends of first and second spaced parallel leaf springs for linear movement toward and away from a paper to be printed upon. A platen is mounted on leaf springs to enable the spacing between the platen and hammers to be varied while maintaining the essential perpendicularity between the platen front face and direction of hammer element movement.

7 Claims, 9 Drawing Figures

DOT MATRIX LINE PRINTER

BACKGROUND OF THE INVENTION

This invention relates generally to dot matrix printer/plotters suitable for producing permanent copy of digitally represented data.

Various devices are well known for producing hard copy printout of digitally represented data. One class of such devices prints fully formed characters, e.g. daisy wheel printers, whereas a different class of devices forms characters within a matrix of dot positions. Although dot matrix impact printers utilizing hammers or wires to strike a paper or ribbon are most widely used, nonimpact dot matrix printers employing other dot printer elements, e.g. ink jet, are also well known.

Within the broad class of dot matrix printers, two different categories are readily commercially available; i.e. (1) serial and (2) line. Both categories of dot matrix printers have been widely discussed in the literature; e.g. see Mini-Micro Systems, January 1981, pages 60 and 97.

The dot matrix serial printer is characterized by the use of a print head, typically having nine vertically spaced wires, mounted to move horizontally back and forth across a paper web mounted for vertical movement. As the head moves across the paper, head solenoids are selectively actuated to impact the wires against the paper to print successive dot columns and thus, serially form characters, each typically within a matrix of nine dot positions high and nine dot positions wide. The paper is stepped after each line of characters is printed.

The dot matrix line printer differs from the serial printer in that a row of dots, rather than a line of characters, is printed between successive paper steps. As is described on page 70 of the aforementioned Mini-Micro Systems publication, a typical commercially available dot matrix line printer utilizes a bank of 44 hammers mounted on a shuttle which sweeps each hammer across three character positions over a 0.3 inch movement. As the shuttle sweeps across, the hammers are actuated at each position in the dot row at which a dot is required and the paper is vertically fed one dot row after each full sweep. The process continues through a total of 7 sweeps (or 9 sweeps when descender characters are to be printed) and then the paper is moved by one character line space, and the process is then repeated for the next line of characters.

Several U.S. Patents are directed to various aspects of dot matrix line printers including: Nos 3,941,051; 4,127,334; 4,236,835.

U.S. patent application Ser. No. 259,697, filed May 1, 1981 discloses an improved dot matrix line printer/plotter including multiple print element banks, each mounted to shuttle across the paper path, and operable to concurrently print different dot rows. The multiple banks are coupled to a common shuttle drive motor and arranged so as to sweep in opposite directions to present an essentially balanced load to the motor. In the disclosed embodiment, each bank carries a plurality of hammer assemblies physically supported on a circuit board mounted for linear reciprocal movement. Each such board preferably carries all of the electronic circuitry uniquely associated with the hammer bank supported thereon. Switch means are provided for enabling a user to selectively disable one of said multiple banks to permit the printer to continue to function even if only one of the banks is operable.

U.S. patent application Ser. No. 374,265, filed May 3, 1982 discloses an improved control system for a dot matrix line printer of the kind generally depicted in application Ser. No. 259,697 for accepting externally supplied data defining a character line to be printed and for deriving dot data bits therefrom to appropriately actuate print elements carried by one or more shuttling banks.

SUMMARY OF THE INVENTION

The present invention is directed to an improved dot matrix line printer of the kind generally depicted in the aforementioned application Ser. No. 259,697 including at least one bank of hammer assemblies mounted to shuttle across the width of a paper web to selectively print dots along a dot row.

In accordance with one significant feature of the invention, an improved hammer assembly is provided in which a dot hammer element is mounted on the free ends of first and second spaced parallel leaf springs for linear movement toward and away from a paper to be printed upon. In the preferred embodiment, the parallel leaf springs are anchored at one end and biased to impact the hammer element against the paper. A magnet is provided for producing a magnetic force, via a path including a block of magnetic material sandwiched between the springs, to normally hold the hammer element in a retracted position against a pole pin. A coil wound on the pole pin is energized to null the magnetic field to permit the springs to propel the hammer element against the paper to print a dot thereon. In accordance with a significant aspect of the preferred embodiment, the leaf springs are not relied on to define the magnetic field path through the hammer element, thus allowing springs of nonmagnetic material to be used thereby permitting optimization of their spring properties.

In accordance with another significant feature of the invention, a platen is mounted on leaf springs to enable the spacing between the platen and hammers to be varied to accommodate different paper thicknesses while assuring that the platen front face remains perpendicular to the hammer motion. In the preferred embodiment, the position of the platen is established by a rotatable cam which bears against the rear face of the platen.

In accordance with a still further feature of the invention, the printer is comprised of a main frame assembly and a shuttle frame assembly hinged thereto for limited pivotal movement around a horizontal hinge axis. The main frame assembly carries a paper drive subassembly and the aforementioned adjustable platen subassembly. The shuttle frame assembly carries one or more hammer banks and a shuttle drive motor for shuttling each bank to move the hammers thereof along a print row extending across the width of the paper parallel to the front face of the platen. By pivoting the shuttle frame assembly up and away from the main assembly, ready access is afforded to the paper path for loading and to the hammer banks for servicing.

BRIEF DESCRIPTION OF THE DRAWINGS

A better understanding of the invention may be had by reference to the following description, taken in conjunction with the accompanying drawing in which.

DESCRIPTION OF THE PREFERRED EMBODIMENT

Figure 1:
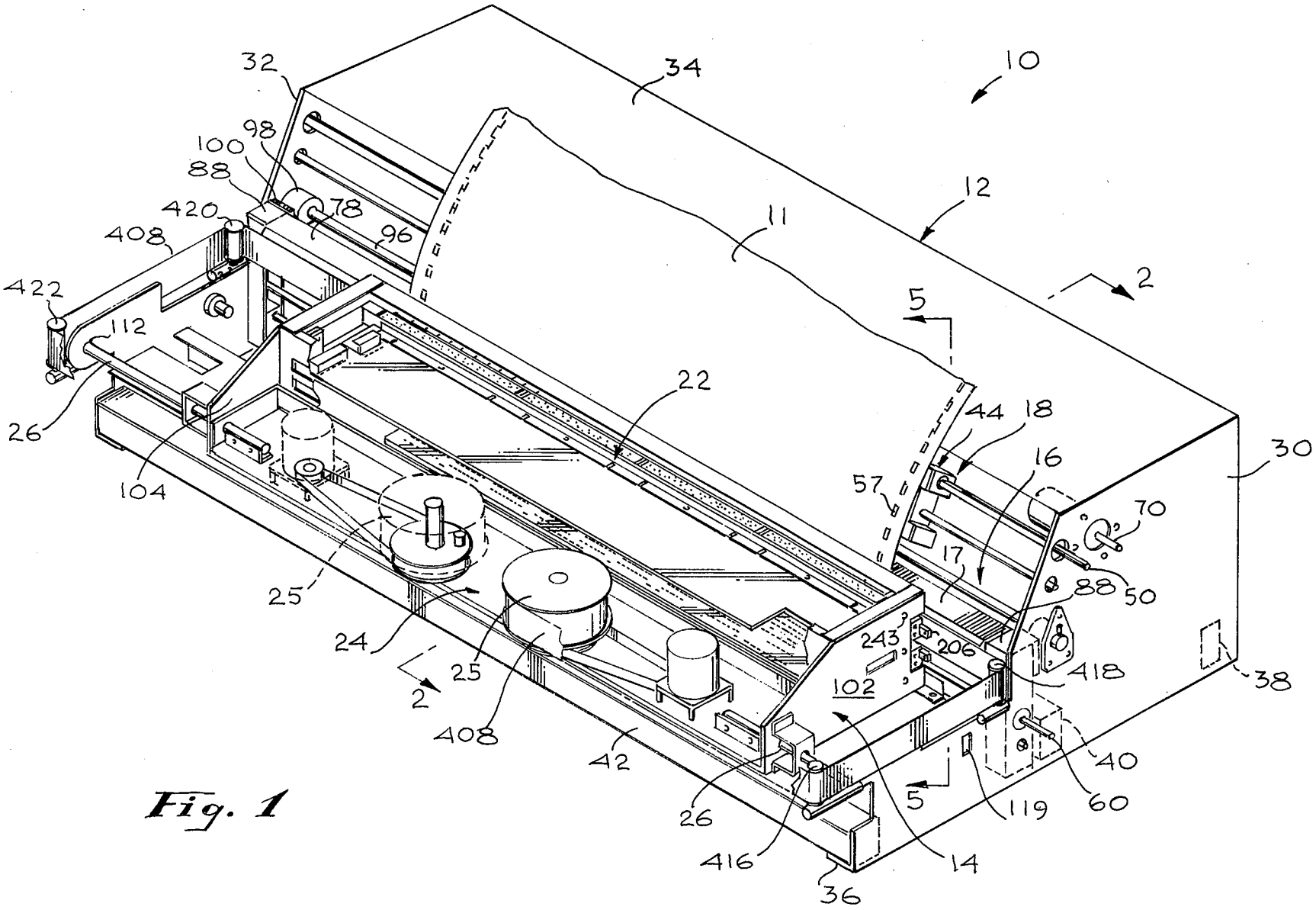
FIG. 1 is an isometric view of a dot matrix line printer in accordance with the invention.
Figure 2:
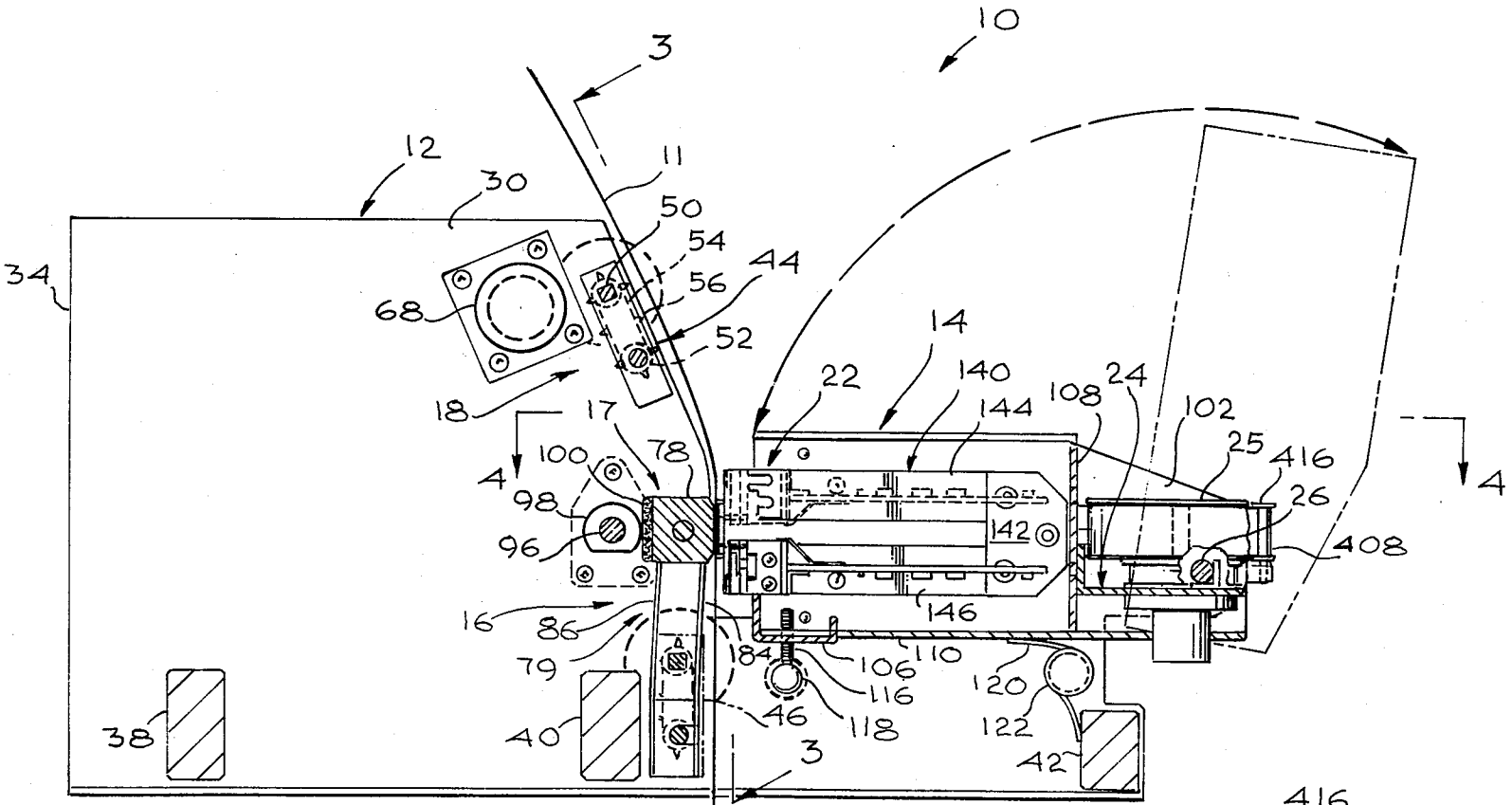
FIG. 2 is a sectional view taken substantially along the plane 2—2 of FIG. 1.
Figure 4:
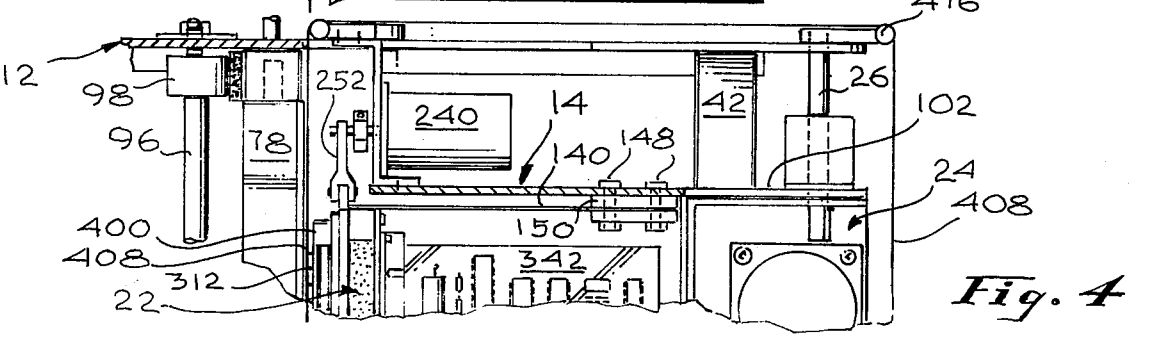
FIG. 4 is a sectional view taken substantially along the plane 4—4 of FIG. 2.

Attention is initially directed to FIGS. 1 and 2 which illustrate a dot matrix line printer 10 in accordance with the present invention. The printer 10 operates to print alphanumeric characters or other defined symbols or plot arbitrary dot patterns, in a manner described in the aforementioned patent application Ser. Nos. 259,697 filed May 1, 1981 and 374,265 filed May 3, 1982. Very briefly, the printer 10 includes one or more hammer banks, each including a plurality of hammer elements mounted along a print row. In operation, with a paper web 11 fixed in position, a hammer bank will shuttle across the width of the paper web with the hammers thereon being selectively actuated to lay down dots along the print row where desired. After each dot row is produced on the paper web, the web is stepped a distance of one dot row along a defined paper path and the hammer bank then lays down a subsequent dot row. The present invention, is directed to a preferred structural embodiment of a printer apparatus of the kind depicted in the aforementioned patent applications.

More particularly, the printer 10 of FIG. 1 is comprised of two primary assemblies; namely, a main frame assembly 12 and a shuttle frame assembly 14. The main frame assembly incudes two primary subassemblies; namely, a platen subassembly 16 and a paper drive subassembly 18 for stepping the paper web 11 past the platen subassembly 16.

The shuttle frame assembly 14 includes one or more hammer bank subassemblies 22, each including a plurality of aligned hammer elements (not clearly visible in FIGS. 1 and 2) defining a print row, and each mounted so as to shuttle across the width of the paper web 11. The plurality of hammer elements on each hammer bank subassembly define a print row and each hammer element operates to selectively lay down dots within a certain field of the print row. For exammple only, in a preferred embodiment of the invention, each hammer bank includes forty four hammer elements and is mounted to shuttle a distance of 0.3 inches. Typically, each hammer element can be selectively actuated to print dots in any of thirty six dot positions within the 0.3 inch field it traverses.

In addition to the hammer banks 22, the shuttle frame assembly 14 supports a ribbon deck subassembly 24. The ribbon deck 24 is adapted to drive two reels 25 which respectively act as ribbon supply and take up reels for moving a ribbon along a path which extends between the hammer elements and the path of the paper web 11.

In accordance with one important feature of the preferred embodiment of the invention, the shuttle frame assembly 14 is mounted for pivotal movement around a hinge axis 26 between an operative position shown in solid line in FIG. 2 in which the hammer elements are positioned in close opposition to the platen 17 of subassembly 16 and an open position, shown in dash line in FIG. 2, in which the shuttle assembly is swung open to allow easy access both to the paper path between the platen and shuttle frame assembly to facilitate paper loading and to the hammer bank subassemblies to facilitate servicing.

Figure 3:
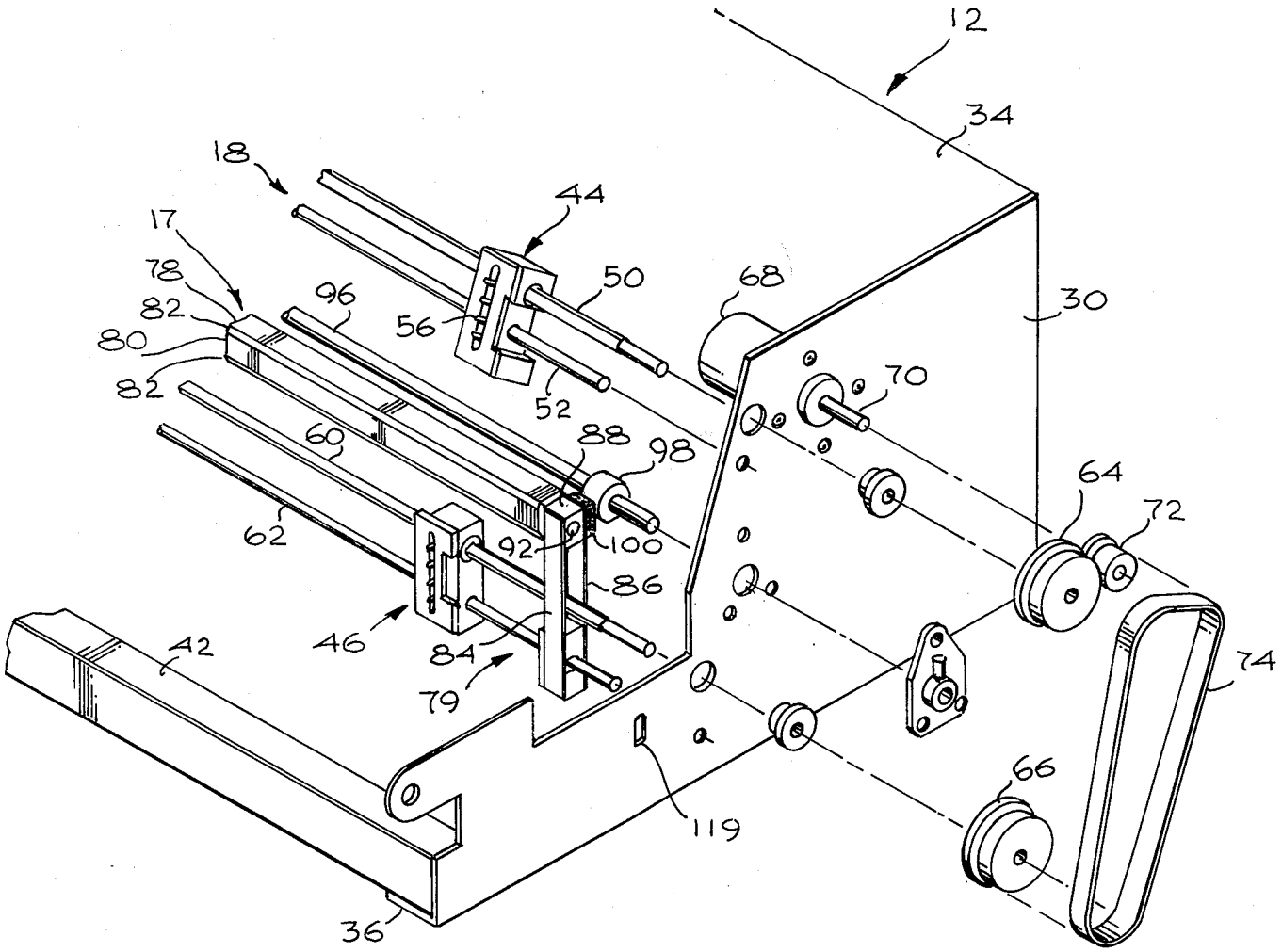
FIG. 3 is an isometric exploded view of the main frame assembly of FIG. 1.

Attention is now directed to FIG. 3, which should be considered in connection with FIGS. 1 and 2, in order to fully understand the structure of the main frame assembly 12. The main frame assembly 12 includes a pair of sidewalls 30,32, a cover 34, and bottom flanges 36. The sidewalls 30,32 are attached by three cross braces 38, 40, and 42.

As previously mentioned, the main frame assembly 12 includes a paper drive subassembly 18 which is preferably comprised of upper and lower paper tractor mechanisms 44 and 46 respectively. The paper tractor mechanisms are substantially conventional and, as can be noted in connection with tractor mechanism, include a drive shaft 50 and an idler shaft 52. An endless belt 54 extends around and is engaged with the shafts 50 and 52. The belt 54 carries sprocket teeth 56 intended to engage edge perforations 57 in the paper web 11. Although not clearly depicted in the drawing, it should be understood that the upper tractor mechanism 44 includes two endless loop belts 54 coupled to the shafts 50 and 52 for engaging both edges of the paper web. The lower tractor mechanism 46 similarly includes two endless belts engaged with drive shaft 60 and idler shaft 62. The drive shafts 50 and 60 extend through the sidewall 30 as depicted in FIG. 3 and carry pulley 64 and 66 respectively. A paper drive motor 68 is mounted on the sidewall 30. The shaft 70 of the motor 68 carries drive pulley 72. Belt 74 engages pulleys 64,66 and 72 to permit the drive motor 68 to selectively rotate the shafts 50 and 60 to move the endless chains in order to move the paper web along a path defined primarily by the tractor means 44 and 46 and the platen subassembly 16 to be discussed hereinafter. The motor 68 preferably comprises a stepper motor which can be commanded to rotate in either direction to thus enable the paper web to be stepped in either direction past the print station defined between the hammer elements and platen.

The main frame assembly 12 also carries a platen subassembly 16 which includes a platen 17 in the form of an elongated bar 78 having a substantially square cross section. More particularly, the bar 78 has a front face 80, preferably relieved at the corners 82. The bar 78 is preferably mounted on a pair of leaf spring mechanisms 79 which permit the bar 78 to move substantially linearly toward and away from the hammer banks with the front face of the bar remaining perpendicular to its direction of movement. More particularly, as can be noted in FIGS. 2 and 3, the platen leaf spring mechanisms are comprised of front and rear leaf springs 84 and 86. Sandwiched between the leaf springs 84 and 86 are upper and lower spacer blocks 88 and 90. The leaf spring mechanisms 79 are secured to the sidewalls of the main frame 12, as is best depicted in FIG. 2. Although only one platen leaf spring mechanism is shown in the drawing, it should be recognized that a pair of such mechanisms are provided with the bar 78 being secured therebetween. The bar 78 is fixed to the leaf spring mechanisms by a screw or pin which is passed through hole 92 in the upper spacer block 88 and then into a hole axially formed in the bar 78.

A rotatable shaft 96 is supported between sidewalls 30 and 32 and carries cams 98 in alignment with the leaf spring mechanisms 79. The cam 98 bears against the rear surface of a wear member 100 secured to the back of leaf spring 86 adjacent the spacer block 88. The leaf springs 84 and 86 are biased to hold the wear member 100 against the surface of cam 98. By rotating the shaft 96, the cams 98 will bear against the wear member 100 enabling the front face 80 of the platen bar 78 to be positioned at a selected distance from the hammer elements on the hammer banks. The front face 80 is dimensioned to span the hammer rows on both hammer banks. Manual means (not shown) are provided for rotating and locking the shaft 96. The position of the platen bar 78 is made adjustable in order to accommodate different thicknesses of the paper web 20 depending upon whether single or multipart paper is being used.

From what has been described thus far, it should now be recognized that the printer 10 of FIGS. 1 and 2 includes a main frame assembly 12 including a paper drive subassembly 18 for stepping a paper web along a path defined by upper and lower tractor mechanisms 44 and 46 and the position of an adjustable platen bar 78. Attention is now directed more particularly toward FIG. 5 which depicts the structure of the shuttle frame assembly 14.

The shuttle frame assembly 14 includes first and second sidewalls 102 and 104 joined by cross brace members 106, 108 and 110. As previously mentioned, the shuttle frame assembly 14 is mounted for pivotal movement with respect to the main frame assembly 12. That is, shafts 26 extend from the sidewalls 102 and 104 through opening 112 in the sidewalls of the main frame assembly 12. This permits the shuttle frame assembly to be pivoted from its operative position shown in full line in FIG. 2 to its inoperative position shown in dash line. When in the closed operative postion, a pair of adjustable studs 116, depending from cross brace 106, rest on precision located stops 118 mounted in openings 119 in the sidewalls 30, 32 of the main frame assembly. Preferably, one end 120 of a coil spring 122 is provided to bear against the lower cross member 110 of the shuttle frame assembly 14 tending to pivot the shuttle frame assembly to the open position shown in dash line in FIG. 2. A latch mechanism (not shown) is provided to latch the shuttle frame assembly to the main frame assembly in its operative position against the force of spring 122 with the stud 116 engaged against the stop 118.

Mounted on the inner side of each of the shuttle frame assembly sidewalls 102 and 104 is a flat C-shaped spring 140. The C-shaped spring includes a bight portion 142 and legs 144 and 146. The springs 140 are secured to the sidewalls 102 and 104, but spaced therefrom, by suitable fastening means such as bolts 148 and spacers 150.

Figure 5:
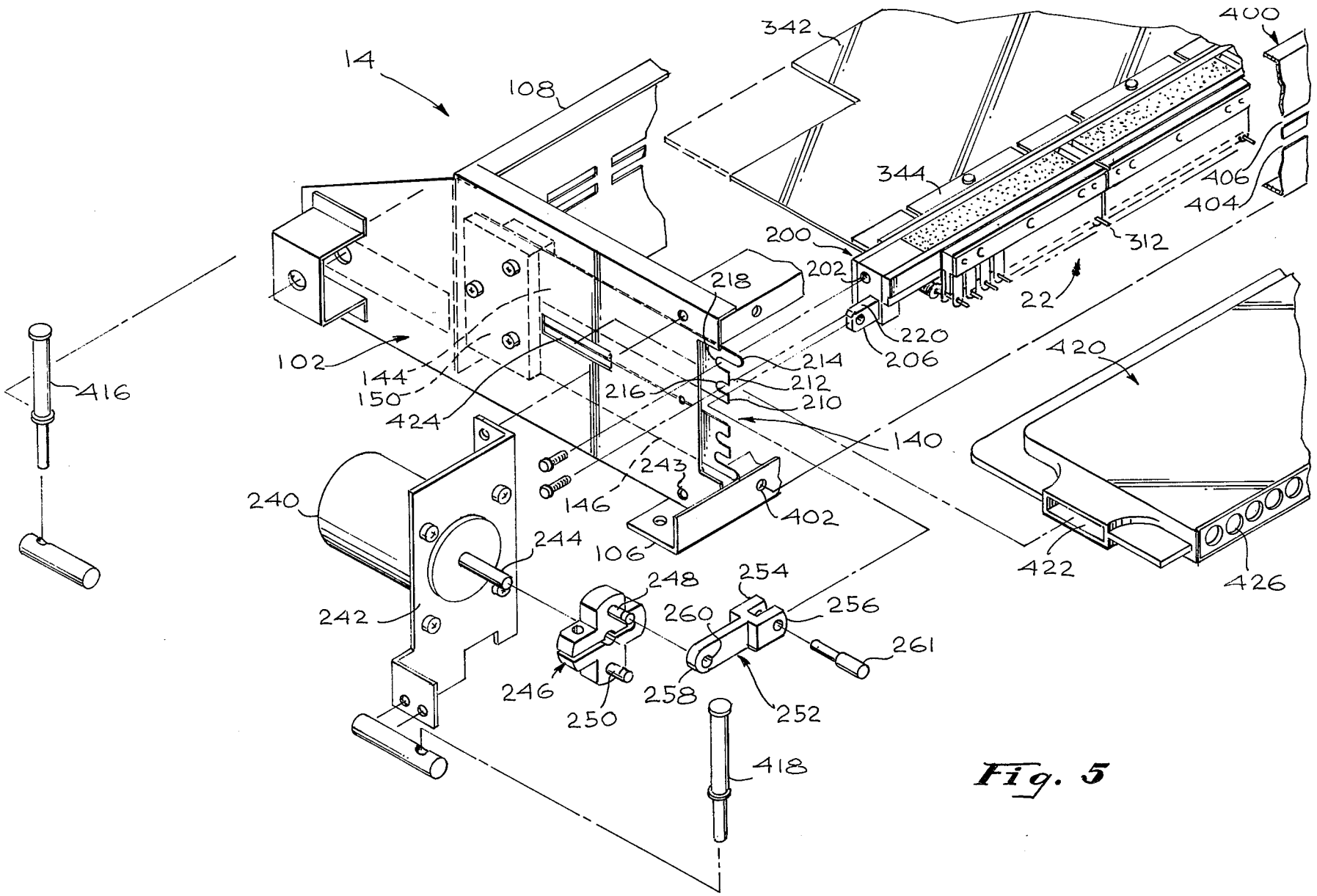
FIG. 5 is an isometric exploded view of the shuttle frame assembly of FIG. 1.
Figure 6:
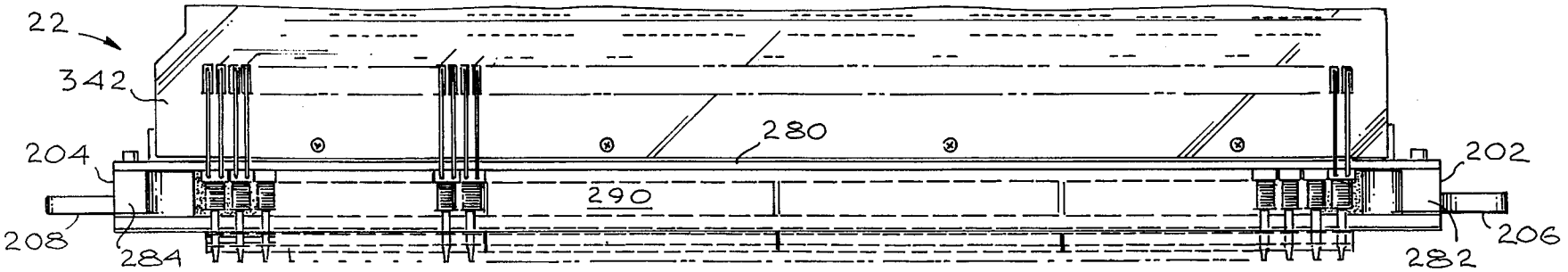
FIG. 6 is a top plan view of one of the hammer banks.
Figure 6A:
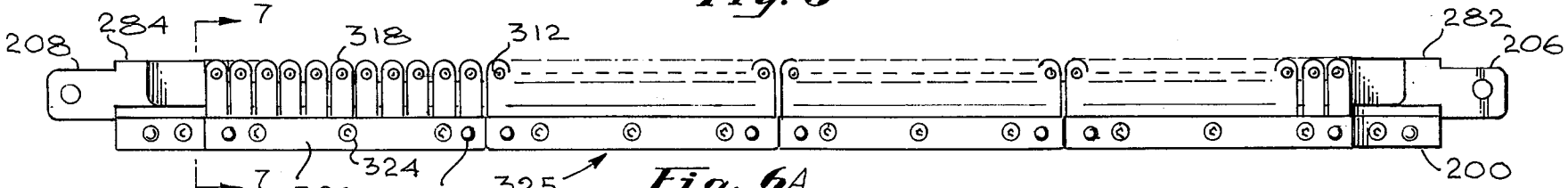
FIG. 6A is a front view of the hammer bank of FIG. 6.
Figure 6B:
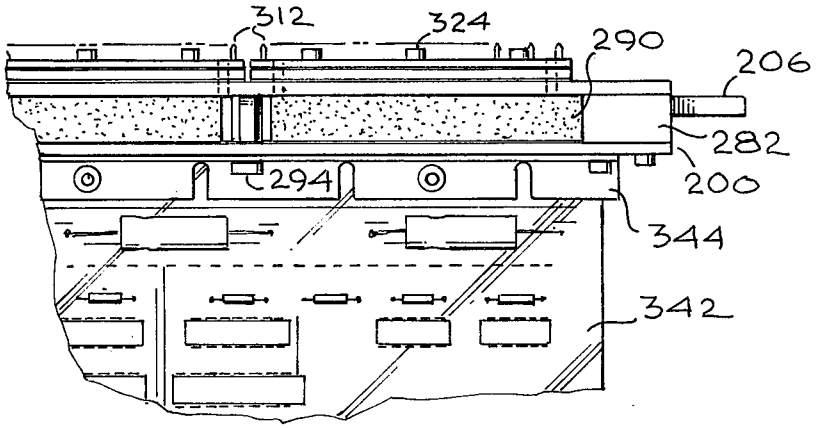
FIG. 6B is a bottom plan view of a portion of the hammer banks of FIG. 6.

Although only one spring 140 is clearly depicted in the drawing, it should be understood that two such springs are provided, respectively mounted inwardly of the shuttle frame sidewalls 102 and 104. In accordance with the invention, a first hammer bank subassembly 22 is mounted between and supported by the upper legs 144 of the opposed springs 140 and a second hammer bank subassembly is mounted between and supported by the lower legs 146 of the opposed springs 140. More particularly, as is depicted in FIGS. 5 and 6, each hammer bank subassembly includes an elongated clevis bar 200 having end surfaces 202 and 204. Extending outwardly from the end surfaces 202 and 204 are ears 206 and 208 respectively.

The outer ends of the legs 144 and 146 of the springs 140 are shaped to mount the clevis bar 200 thereto. That is, the end of each of the legs 144 and 146 includes three fingers (FIG. 5) 210, 212, and 214. The fingers define therebetween slots 216 and 218. Note that finger 214 extends outwardly beyond fingers 210 and 212.

In mounting the clevis bar 200 to the end of spring leg 144, suitable fastening means such as screws are placed through slots 216 and 218 and threaded into openings in the end surfaces (e.g. 200) of bar 200. The lower surface (as depicted in FIG. 5) of finger 214 defines a reference surface against which the upper surface 220 of ear 206 bears. The forward edges of fingers 210 and 212 define a reference surface which bears against the rear surface of ear 206. The bar 200 depicted in FIG. 5 is similarly supported by the upper leg 144 of the spring secured to sidewall 104, not shown in FIG. 5. Similarly, the bar 200 of a second hammer bank subassembly is secured in an identical manner between the lower legs 146 of the same springs mounted to the sidewalls 102 and 104. By mounting the hammer bank subassembly clevis bars to the springs as aforedescribed, the hammer banks are able to shuttle, i.e. exhibit reciprocal linear movement, across the width of the paper web but are restrained from any other motion.

In order to reciprocally move the clevis bars 200, a shuttle drive stepper motor 240 (FIG. 5) is secured by bracket 242 to the outside of sidewall 102 by bolts extending through holes 243. Secured to the shaft 244 of motor 240 is a cruciform 246 carrying pins 248 and 250 displaced by 180 degrees around the shaft 244. A clevis 252 is provided having spaced apertured arms 254 and 256 and a common leg 258. An aperture 260 in the common leg 258 receives the pin 248 on the cruciform 246. The ear 206 on clevis bar 200 is placed between the spaced arms 254 and 256 of the clevis and a pin 261 extends through the openings in the arms 254 and 256 and the ear 206 to secure the clevis bar 200 to the clevis.

Although not depicted in the drawing, it should be understood that a clevis 252 will be mounted on each of the pins 248 and 250 of the cruciform 246 and each clevis will be similarly coupled to a different clevis bar 200 mounted between the C-shaped springs 140. In this manner, the two clevis bars 200 will always move in opposite directions whereby the motor 240 will see a balanced load regardless of its direction of rotation.

Figure 7:
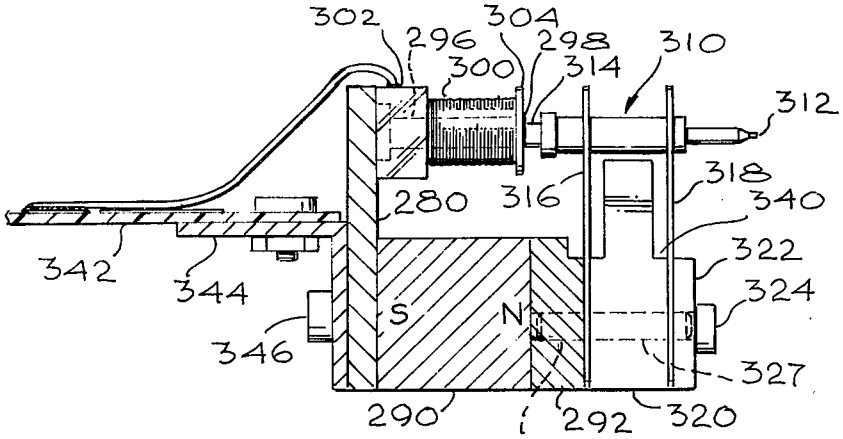
FIG. 7 is a sectional view of a hammer assembly taken along the plane 7—7 of FIG. 6A.

Attention is now directed to FIGS. 6 and 7 which illustrate the structure of a hammer bank subassembly 22 in accordance with the present invention. It has been pointed out that an element of the hammer bank subassembly comprises a clevis bar 200. The clevis bar 200 includes an elongated back portion 280 carrying forwardly projecting blocks 282 and 284 at its ends. The blocks 282 and 284 define the aforementioned end surfaces 202 and 204 which receive fasteners to mount the bars on the legs of springs 140. The ears 206 and 208 extend respectively from the blocks 282 and 284.

An elongated permanent magnet 290 is clamped to the back portion 280 of bar 200 by a clamp plate 292 secured to the bar 200 by fasteners 294. A plurality of pole pins 296 project from the bar 200 above the bar magnet 290 (as depicted in FIG. 7). The pole pins 296 terminate at their free end at a gap face 298. A coil 300 is wound in each pole pin and fixed in position between spacers 302 and 304.

A plurality of hammer elements 310 are provided, each hammer element being supported in alignment with a pole pin 300 for movement toward and away from the pole pin gap face 298. More particularly, each hammer element 310 comprises a substantially cylindrical body terminating at one end 312 in a hammer tip and at a second end 314 in a pole piece. The hammer element 310 is supported between the free ends of first and second leaf springs 316 and 318. The second or lower (as depicted in FIG. 7) ends of the leaf springs are anchored to a block 320. A clamping plate 322 clamps the leaf springs 316 and 318 and the block 320 to the aforementioned clamping plate 292 by fasteners 324.

Preferably, the hammer elements 310 are arranged in groups to facilitate service and repair. Thus, for example, as is depicted in FIG. 6, each of the blocks 320 and clamping plates 322 define a module spanning eleven hammer elements. Thus, in a forty four hammer subassembly, four separate hammer modules 325 would be provided, each being individually replacable. Each module 325 is precisely located on clamping plate 292 by dowels 327 projecting from block 320 into location holes 328 extending into clamping plate 292.

It should be understood that the bar 200, the pole pins 296, the hammer elements 310, the blocks 320, and the clamping plate 292 are all formed of magnetic material. Thus, a closed magnetic loop is defined from one pole face of the bar magnet 290 through the clamping plate 292, through the block 320, through a short gap to the cylindrical hammer element 310, through a working gap between the pole piece 314 and the gap face 298 of the pole pin 296, and then through the bar 200 to the other face of the bar magnet 290. It is pointed out that this closed magnetic path does not necessarily include the leaf springs 316 and 318, thereby permitting the springs to be formed of a material, such as beryllium copper or beryllium nickel, to optimize its spring properties without necessitating that it also have good magnetic properties. It should of course be recognized that the block 320 extends close to the hammer element 310 to minimize the gap therebetween. It is also pointed out that the block 320 is relieved at shoulders 340 in order to permit flexing of the leaf springs 316 and 318.

The springs 316 and 318 are biased so as to move the hammer element 310 to the right as depicted in FIG. 7 to engage the hammer tip 312 against the paper web 20 when the shuttle frame assembly is in the closed operative position depicted in solid line in FIG. 2. The force produced by the magnetic field through the aforedescribed path causes the hammer element 310 to be pulled back against the gap face 298 of pole pin 296. Energization of the coil 300 nulls the magnetic field thereby releasing the hammer element 310 and permitting the springs 316 and 318 to propel the hammer element 310 toward the paper path and permitting the hammer tip to print a dot on the paper. The utilization of spaced parallel springs 316 and 318, anchored as indicated, and carrying the hammer element 310, forms a parallelogram to assure the substantially linear motion of the hammer element 310 toward the front face 80 of the platen 78.

As is described in the aforementioned patent applications, each hammer bank assembly preferably has mounted thereon a printed circuit board which carries the electronics for that hammer bank subassembly. The printed circuit board is depicted at 342 in FIG. 7 being secured to the bar 200 by bracket 344 and fasteners 346. Electrical leads extend from the board 342 to each of the coils 300.

Returning to FIG. 5, attention is called to element 400 comprising a hammer tip shield. More particularly, the element 400, only a portion of which is illustrated in FIG. 5, comprises an elongated plate intended to be mounted to the shuttle frame assembly in mounting holes 402. The plate 400 includes elongated slots 404 and 406 which are aligned with the rows of hammer tips 312 formed on the upper and lower hammer banks. The purpose of the shield 400 is to provide a path for the ribbon, to be discussed hereinafter, as it moves past the hammer tips and to prevent the ribbon from becoming snared on a tip.

The ribbon, illustrated at 408 in FIG. 1, is carried between the aforementioned reels 25. Each of the reels 25 is driven by its own motor carried by the ribbon deck 24. The ribbon path extends from the rightmost reel shown in FIG. 1, around guide post 416, and then along a short segment extending substantially parallel to shuttle frame assembly sidewall 102. The ribbon then turns around guide post 418, engaging the surface of shield 400 in front of the two rows of hammer tips 312. The ribbon then returns to the left reel, as depicted in FIG. 1, around guide posts 420 and 422. Note, that the ribbon path is arranged so that it does not interfere with the pivotal movement of the shuttle frame assembly from the closed operative position to the open position as depicted in FIG. 2.

In addition to the foregoing, it is also pointed out that an air plenum 420 (FIG. 5) is provided. The plenum 420 is provided with an air entrance opening 422 which, when the plenum is properly mounted to the shuttle frame assembly between the two hammer banks, aligns with opening 424 in sidewall 102. A blower (not shown) forces air through the openings 422 and 424 which exits from a plurality of holes 426 located proximate to the hammer coils to produce cooling.

From the foregoing, it should be recognized that an improved dot matrix line printer structure has been disclosed herein characterized principally by the use of a main frame and shuttle frame assembly pivoted to one another to afford easy access for paper loading and hammer bank servicing. In addition, an improved hammer subassembly arrangement is disclosed in which each hammer element is supported on a pair of spaced parallel leaf springs which assure substantially linear axial movement of the hammer element. The leaf springs do not form part of the magnetic path through the hammer elements and thus can be optimized for their spring characteristics. Still further, it should be appreciated that the foregoing specification discloses an improved platen subassembly including a platen having a front face which spans two hammer rows and can be readily adjusted to achieve a desired spacing to the hammer tips. The platen mounting means enables the position of the front face to be adjusted while assuring it remains perpendicular to the direction of hammer movement.

We claim:

1. A dot matrix line printer comprising:

a main frame;

a paper drive subassembly mounted on said main frame including means for engaging a paper web for stepping said web along a paper path extending in the direction of the elongation of said web;

a platen subassembly mounted on said main frame including a platen having a flat flat front face extending along a portion of said paper path and across substantially the entire width of said paper web adjacent a rear surface thereof;

a shuttle frame;

a first hammer bank subassembly including a plurality of dot hammer elements mounted in alignment to define a print row, each hammer element mounted for substantially linear movement toward and away from said platen front face said shuttle frame including means mounting said first hammer bank subassembly for reciprocal linear movement along said print row in a direction extending parallel to the width of said paper web;

means mounting said shuttle frame relative to said main frame for pivotal movement about an axis extending parallel to the width of said paper web between an operating position with said print row extending parallel to said platen front face adjacent the front surface of said paper web and an open position affording access to said hammer elements and the paper path between said hammer elements and said platen;

said platen subassembly further including platen mounting means comprising at least one pair of first and second spaced parallel leaf springs, each of said leaf springs having a first end anchored and a second end attached to said platen for allowing substantially linear movement of said platen front face toward and away from said print row while maintaining said front face perpendicular to the direction of hammer element movement; and cam means bearing against said platen to position said platen front face a selected distance from said hammer elements.

2. The printer of claim 1 wherein said paper drive subassembly includes upper and lower tractor means for engaging said paper web on opposite sides of said platen.

3. The printer of claim 1 wherein said means mounting said first hammer bank subassembly includes first and second flat springs mounted so as to flex only in a direction extending parallel to the width of said paper web;

said first hammer bank subassembly secured to and supported between said first and second flat springs.

4. The printer of claim 3 including a second hammer bank subassembly;

third and fourth flat springs mounted on said shuttle frame so as to flex only in a direction extending parallel to the width of said paper web;

said second hammer bank subassembly secured to and supported between said third and fourth flat springs.

5. The printer of claim 3 including a shuttle drive motor mounted on said shuttle frame; and means coupling said shuttle drive motor to said first hammer bank subassembly for selectively moving said subassembly in first and second opposite directions along a path extending parallel to the width of said paper web.

6. The printer of claim 1 further including ribbon supply means and ribbon take up means supported on said shuttle frame; and ribbon guide means supported on said shuttle frame for guiding a ribbon from said supply means, between said print row and said platen, to said take up means.

7. A printer including a drive means for moving a paper web along a defined path extending in the direction of the elongation of the web and a row of print elements mounted adjacent a front surface of said web for movement perpendicular thereto for printing thereon, an improved platen subassembly comprising:

platen means having a flat front face extending along a portion of said path and across substantially the entire width of said paper web adjacent a rear surface thereof;

at least one pair of first and second spaced parallel leaf springs, each of said leaf springs having its first end fixedly secured and its second end attached to said platen means for allowing substantially linear movement of said front face toward and away from said paper path while maintaining the orientation of said front face perpendicular to the direction of movement of said print elements;

adjustable means engaging said platen means to position said front face a selected distance from said print elements, said adjustable means including a cam bearing against said platen means; and means mounting said cam for rotation relative to said platen means for translating the position of said front face relative to said print elements.

* * * * *